US006896575B2

(12) United States Patent
Fair et al.

(10) Patent No.: US 6,896,575 B2
(45) Date of Patent: May 24, 2005

(54) FOLDABLE INFANT ACTIVITY CENTER

(75) Inventors: Paul Fair, Denver, CO (US); Jeffrey Steininger, St. Marys, OH (US)

(73) Assignee: Evenflo Company, Inc., Vandalia, OH (US)

( * ) Notice: Subject to any disclaimer, the term of this patent is extended or adjusted under 35 U.S.C. 154(b) by 22 days.

(21) Appl. No.: 10/435,007

(22) Filed: May 9, 2003

(65) Prior Publication Data

US 2004/0253903 A1 Dec. 16, 2004

(51) Int. Cl.[7] ..... A63H 3/28
(52) U.S. Cl. ..... 446/227; 297/16.1
(58) Field of Search ..... 297/16.1, 440.1, 297/136, 5, 137, DIG. 11; 446/227; 482/77, 78, 66; 472/135, 102–105

(56) References Cited

U.S. PATENT DOCUMENTS 3,796,430 A * 3/1974 Sudo ..... 280/87.05
4,025,083 A * 5/1977 Saint ..... 280/87.05
4,171,847 A * 10/1979 Tukui ..... 297/5
4,226,467 A * 10/1980 Boudreau ..... 297/5
5,104,180 A 4/1992 Takahashi et al.
5,241,716 A 9/1993 Kohus
5,380,262 A * 1/1995 Austin ..... 482/68
5,518,475 A * 5/1996 Garland ..... 482/68
5,544,372 A 8/1996 Garland et al.
5,581,827 A 12/1996 Fong et al.
5,700,201 A * 12/1997 Bellows et al. ..... 472/103
5,779,386 A 7/1998 Eichhorn
5,785,383 A 7/1998 Otero
5,813,948 A * 9/1998 Quigg et al. ..... 482/67
5,839,706 A 11/1998 Liu
5,937,461 A 8/1999 Dombrowski et al.
6,179,376 B1 * 1/2001 Meeker et al. ..... 297/137
6,517,151 B2 * 2/2003 Liu ..... 297/16.1

OTHER PUBLICATIONS

Safety 1st, Play dee Stationary Activity Center, website advertisement, Feb. 13, 2002.
Baby Trend, Play–In–Place Exerciser, website advertisement, Feb. 13, 2002.

* cited by examiner

*Primary Examiner*—Derris H. Banks
*Assistant Examiner*—J Williams
(74) *Attorney, Agent, or Firm*—Taft, Stettinius & Hollister LLP

(57) ABSTRACT

An infant activity center includes a tray, a base and substantially-straight pylons. The tray has an infant-receiving opening. Each pylon has a lower portion which is directly or indirectly rotatably attached to the base and each pylon has an upper portion which is directly or indirectly rotatably attached to the tray enabling the tray and the base to be relatively rotated and folded from a use position to a storage position. Each of the pylons is substantially vertical when the tray and the base are in the use position.

16 Claims, 9 Drawing Sheets

FOLDABLE INFANT ACTIVITY CENTER

TECHNICAL FIELD

The present invention relates generally to infant activity centers, and more particularly to an infant activity center which is foldable.

BACKGROUND

Conventional infant activity centers include, without limitation, infant walkers, infant exercisers, infant bouncers, infant toy centers, infant eating centers, etc. having a lower base and having an upper tray with a child-receiving opening. The term "infant" includes a baby, an infant, and a child. Some conventional infant activity centers allow the upper tray to be folded with respect to the lower base for ease of carry and storage.

Known infant activity centers include a baby exerciser having a lower base, an upper tray with a child-receiving opening, and four bent metal tubes used in connecting the upper tray to the lower base. Four upper connecting members are attached to the tray and are rotatable with respect to the tray about their vertical axes. The upper end of each tube is attached to a corresponding upper connecting member and is rotatable about a horizontal axis with respect to the corresponding upper connecting member. Four lower connecting members are attached to the base and are rotatable with respect to the base about their vertical axes. The lower end of each tube is attached to a corresponding lower connecting member and is rotatable about a horizontal axis with respect to the corresponding lower connecting member. A line drawn between the lower and upper ends of each bent tube is tilted at an angle of about forty-five degrees away from the vertical in the use position. A button on each lower connecting member unlocks the corresponding tube allowing it to rotate about the horizontal axis with respect to the lower connecting member allowing the tray to be rotated with respect to, and folded toward, the base for storage. Each leg has three alternate attachment holes for attaching the tube to the lower connecting member to adjust the height of the tray above the base in the use position.

What is needed is an improved infant activity center.

SUMMARY

A first expression of an embodiment of the invention is for an infant activity center including an infant-activity-center tray, a base, and a plurality of substantially-rectilinear pylons. The tray has an infant-receiving opening. Each of the pylons has a lower portion which is directly or indirectly rotatably attached to the base and each of the pylons has an upper portion which is directly or indirectly rotatably attached to the tray enabling the tray and the base to be relatively rotated and folded from a use position to a storage position The distance between the tray and the base is greater in the use position than in the storage position. Each of the pylons is substantially vertical when the tray and the base are in the use position.

A second expression of an embodiment of the invention is for an infant activity center including an infant-activity-center tray, a plurality of upper connecting members, a base, a plurality of lower connecting members, and a plurality of substantially-rectilinear pylons. The tray has an infant-receiving opening. The upper connecting members are each attached to the tray and are each rotatable with respect to the tray only about a corresponding substantially-vertical upper axis. The lower connecting members are each attached to the base and are each rotatable with respect to the base only about a corresponding substantially-vertical lower axis. The pylons each have a lower portion which is attached to a corresponding lower connecting member and which is rotatable with respect to the corresponding lower connecting member only about a corresponding substantially-horizontal lower axis and each have an upper portion which is attached to a corresponding upper connecting member and which is rotatable with respect to the corresponding upper connecting member only about a corresponding substantially-horizontal upper axis enabling the tray and the base to be relatively rotated and folded from a use position to a storage position. The distance between the tray and the base is greater in the use position than in the storage position. Each of the pylons is substantially vertical when the tray and the base are in the use position.

Several benefits and advantages are derived from one or more of the expressions of an embodiment of the invention. Having the pylons be substantially-rectilinear (i.e., substantially-straight) pylons which are substantially vertical when the tray and the base are in the use position provides for a stronger use position for like materials than pylons which are bent and/or which are tilted at an angle of about 45 degrees away from the vertical when the tray and the base are in the use position. A pylon which is vertical in the use position can be a two-piece inner-and-outer sleeve pylon providing for height adjustment without changing the vertical alignment of the pylon in the use position.

DETAILED DESCRIPTION

Figure 1:
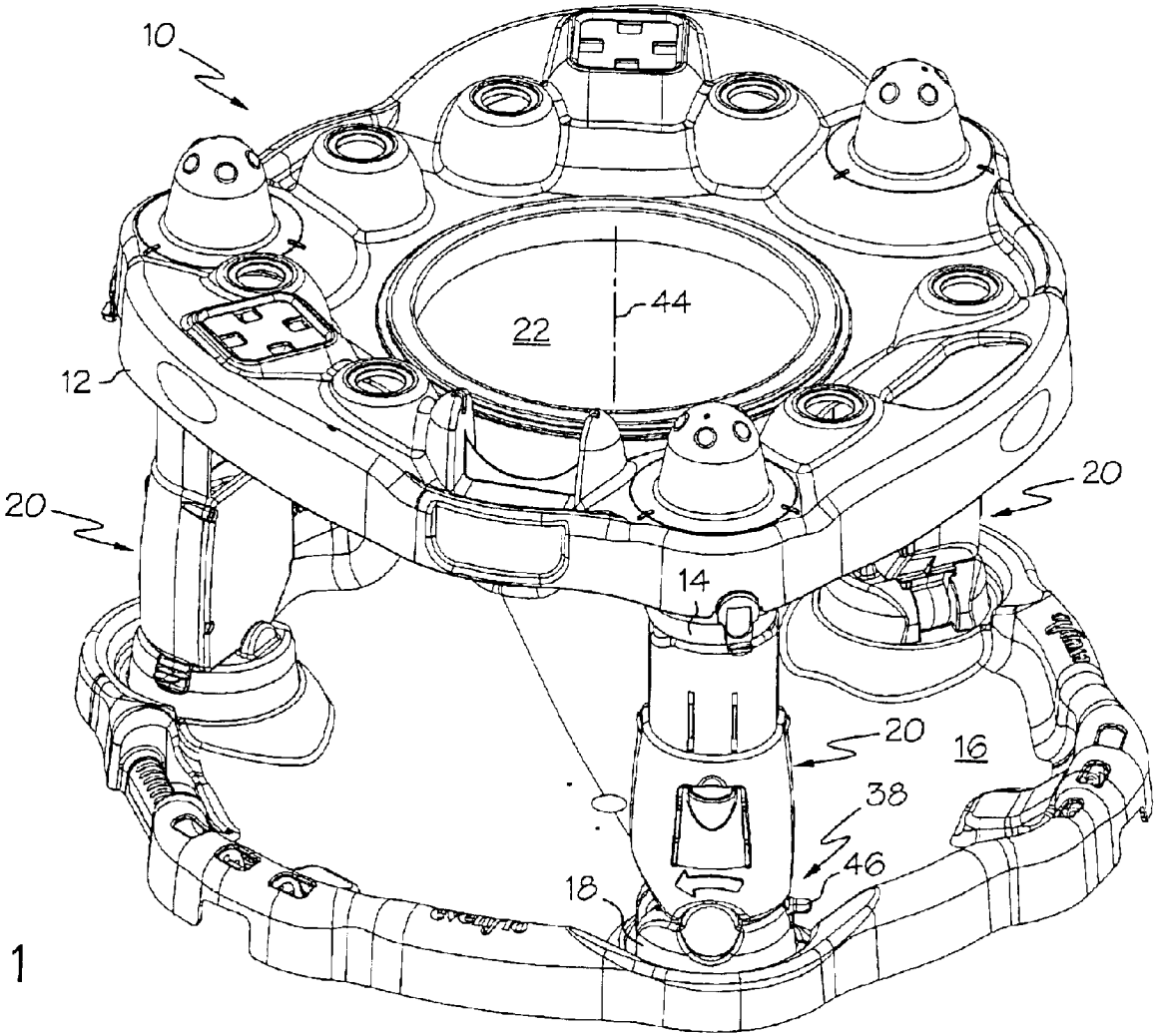
FIG. 1 is perspective view of an embodiment of the infant activity center of the invention in the use configuration.
Figure 2:
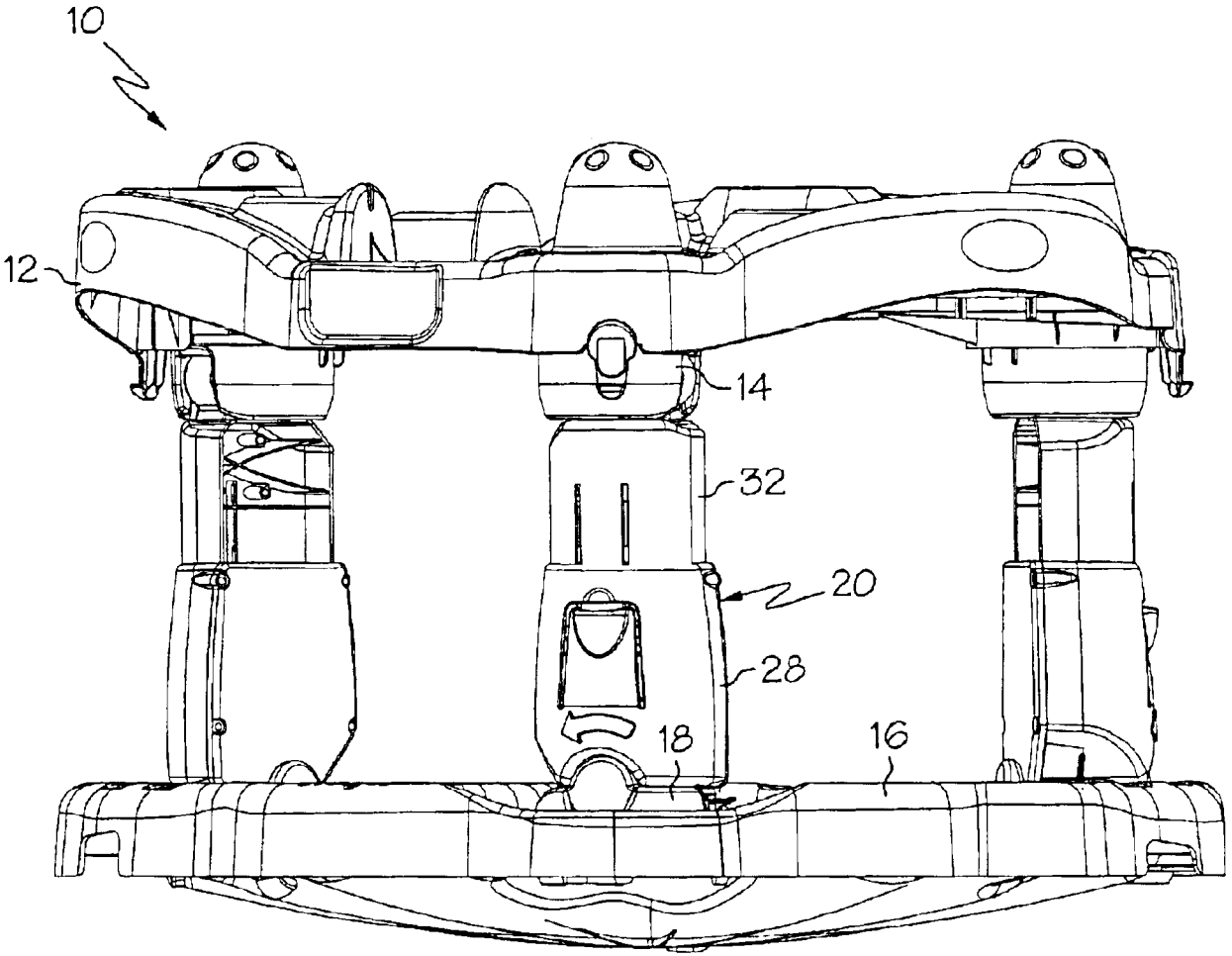
FIG. 2 is a front elevational view of the infant activity center of FIG. 1 shown in the use configuration.
Figure 3:
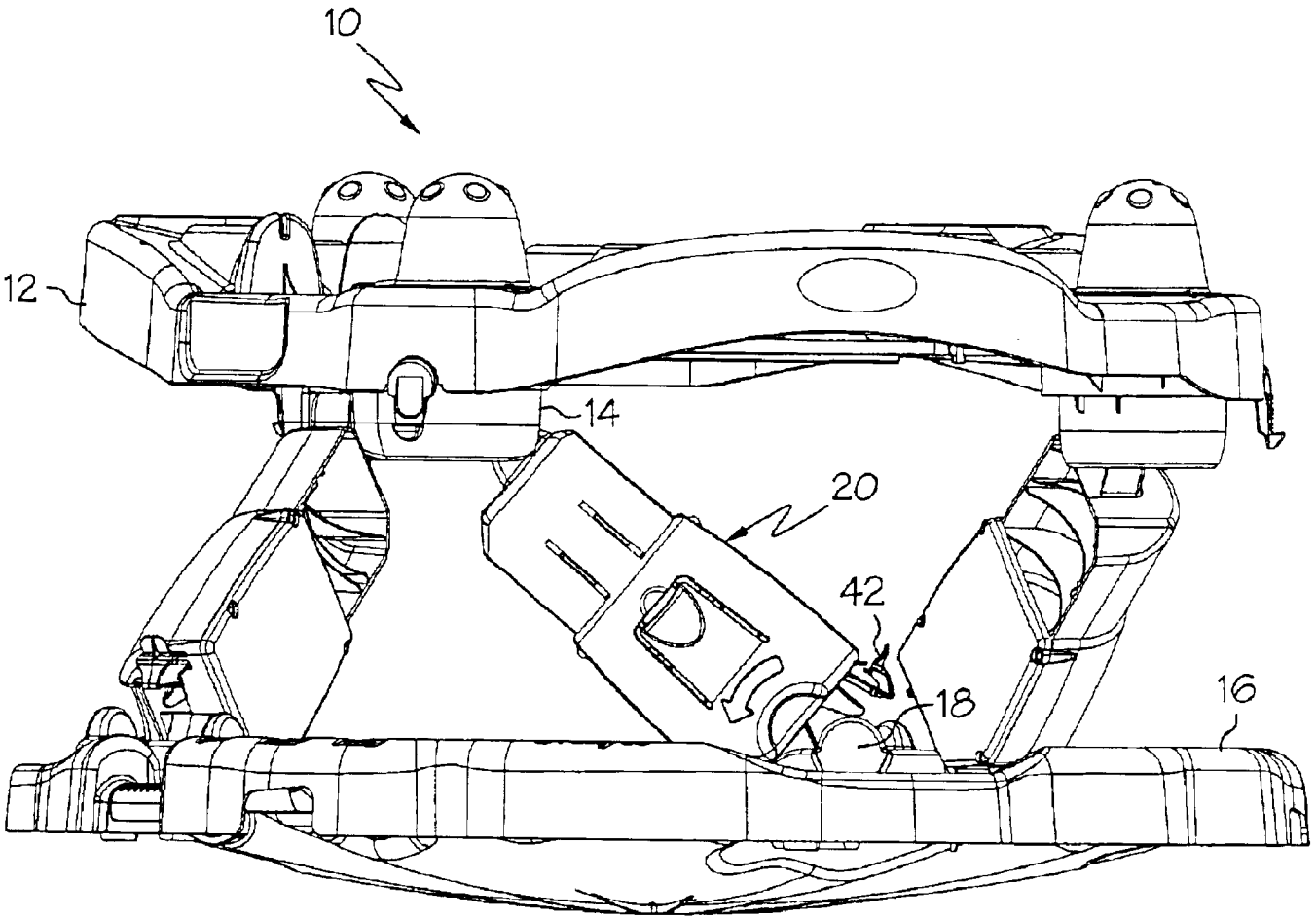
FIG. 3 is a view, as in FIG. 2, but with the tray partially rotated with respect to the base and with the tray partially folded toward the base.

Referring now to the drawings, FIGS. 1–9 illustrate an embodiment of the present invention. A first expression of the embodiment shown in the figures is for an infant activity center 10. The term "infant" includes a baby, an infant, and a child. The terminology "infant activity center" includes, without limitation, infant walkers, infant exercisers, infant bouncers, infant toy centers, infant eating centers, etc.

In a first expression of the embodiment shown in the figures, the infant activity center 10 includes an infant-activity-center tray 12, a base 16, and a plurality of substantially-rectilinear pylons 20. The tray 12 has an infant-receiving opening 22. The pylons 20 each have a lower portion 28 which is directly or indirectly rotatably attached to the base 16 and each have an upper portion 32 which is directly or indirectly rotatably attached to the tray 12 enabling the tray 12 and the base 16 to be relatively rotated and folded from a use position (seen in FIGS. 1–2) to a storage position (seen in FIG. 4). The distance between the tray 12 and the base 16 is greater in the use position than in the storage position. Each of the pylons 20 is substantially vertical when the tray 12 and the base 16 are in the use position. By "substantially vertical" is meant within thirty degrees of vertical when the base 16 is placed on a horizontal surface. In one variation, the tray 12 is rotated either clockwise or counterclockwise with respect to the base 16 to rotate and fold the tray 12 from the use position to the storage position. In one modification, the lower portion 28 of one or more pylons 20 is rotatably attached to the base 16 using a ball and socket joint (not shown) and/or the upper portion 32 of one or more pylons 20 is rotatably attached to the tray 12 using a ball and socket joint (not shown). In one variation, at least one of the rotatable attachments is a two axes of rotation attachment. Other types of rotatable attachments are left to the artisan.

In one illustration of the first expression of the embodiment shown in the figures, the infant activity center 10 includes an infant-activity-center tray 12, a plurality of upper connecting members 14, a base 16, a plurality of lower connecting members 18, and a plurality of pylons 20. The tray 12 has an infant-receiving opening 22. The upper connecting members 14 are each attached to the tray 12 and are each rotatable with respect to the tray 12 about a corresponding substantially-vertical upper axis 24. The lower connecting members 18 are each attached to the base 16 and are each rotatable with respect to the base 16 about a corresponding substantially-vertical lower axis 26. The pylons 20 each have a lower portion 28 which is attached to a corresponding lower connecting member 18 and which is rotatable with respect to the corresponding lower connecting member 18 about a corresponding substantially-horizontal lower axis 30 and each have an upper portion 32 which is attached to a corresponding upper connecting member 14 and which is rotatable with respect to the corresponding upper connecting member 14 about a corresponding substantially-horizontal upper axis 34 enabling the tray 12 and the base 16 to be relatively rotated and folded from a use position (seen in FIGS. 1–2) to a storage position (seen in FIG. 4). The distance between the tray 12 and the base 16 is greater in the use position than in the storage position. It is noted that the term "attached" includes directly attached and includes indirectly attached, as can be appreciated by the artisan. It is further noted that the terms "lower" and "upper" are used merely for differentiation and describe relative positioning in the use position but not necessarily in the storage position.

In one enablement of the first expression of the embodiment shown in the figures, a seat (not shown) is disposed in the infant-receiving opening 22 and attached to the tray 12. In one variation, the seat is rotatable allowing the infant to turn relative to the tray 12, the base 16 is curved allowing rocking by the infant, and the attachment of the upper connecting member 14 to the tray 12 includes a spring (not shown) allowing bouncing by the infant as can be appreciated by those skilled in the art. In the same or a different variation, various play objects (not shown) such as toys and mirrors are attached to the tray 12. In the same or a different variation, the tray includes other objects (not shown) such as a cup holder, a crayon receptacle, etc. In one modification, the infant-receiving opening 22 is disposed over a solid portion of the base 16. In another modification, with or without a seat, the infant-receiving opening 22 is disposed over an opening (not shown) in the base 16 whether or not wheels (not shown) are attached to the base 16. Other enablements, variations, and modifications are left to the artisan.

In one arrangement of the first expression of the embodiment shown in the figures, the substantially-horizontal lower and upper axes 30 and 34 of each pylon 20 are always substantially parallel. In the same or a different arrangement, each of the pylons 20 has a longitudinal axis 36 which is substantially vertical when the tray 12 and the base 16 are in the use position. Typically, the base 16 is supported by a floor or level ground in the use position. In the same or a different arrangement, the longitudinal axis 36 of each of the pylons 20 is substantially horizontal when the tray 12 and the base 16 are in the storage position. By "substantially horizontal" is meant within thirty degrees of the horizontal when the base 16 is placed on a horizontal surface.

Figure 4:
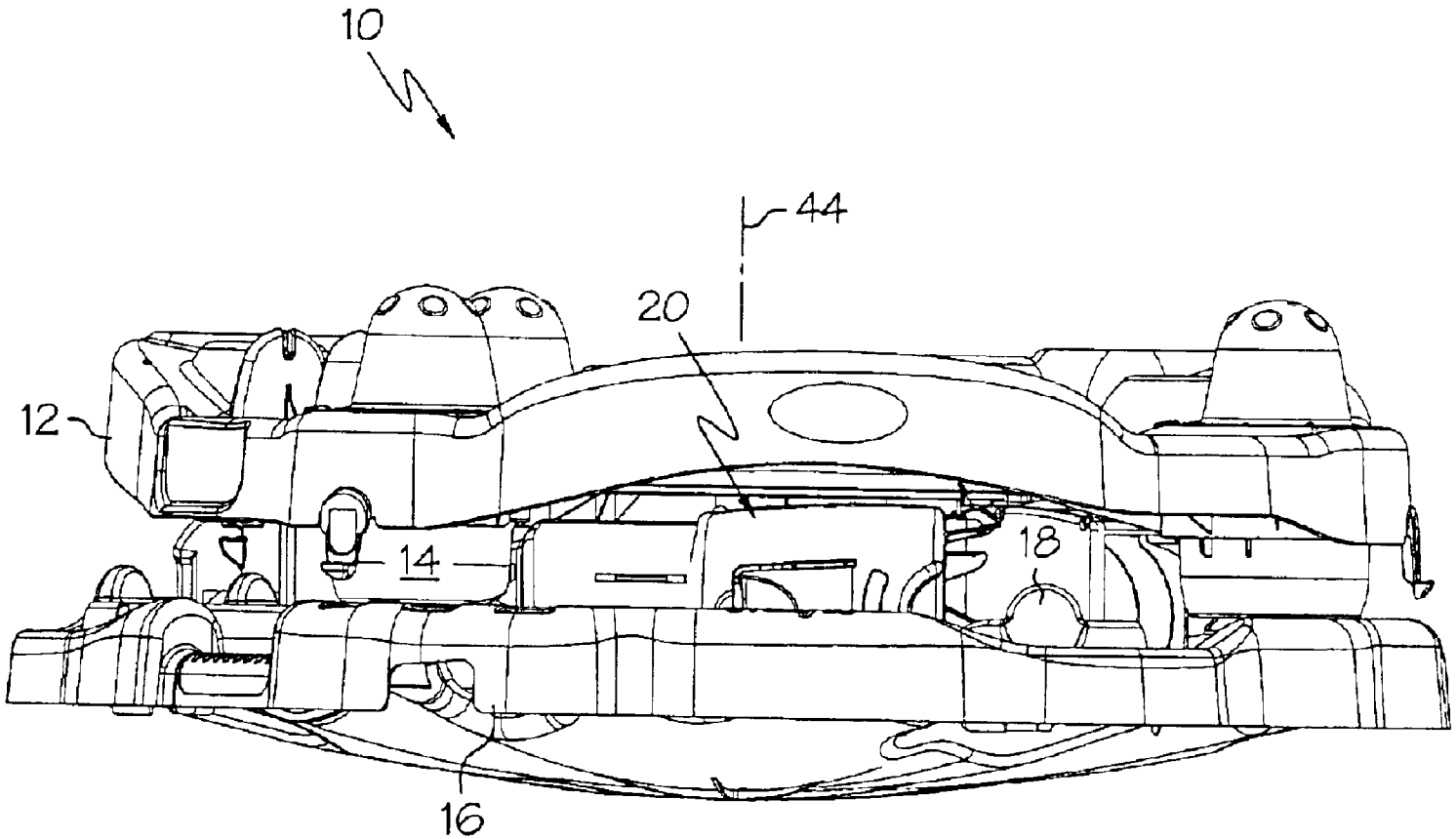
FIG. 4 is a view, as in FIG. 2, showing the infant activity center in the storage configuration.
Figure 5:
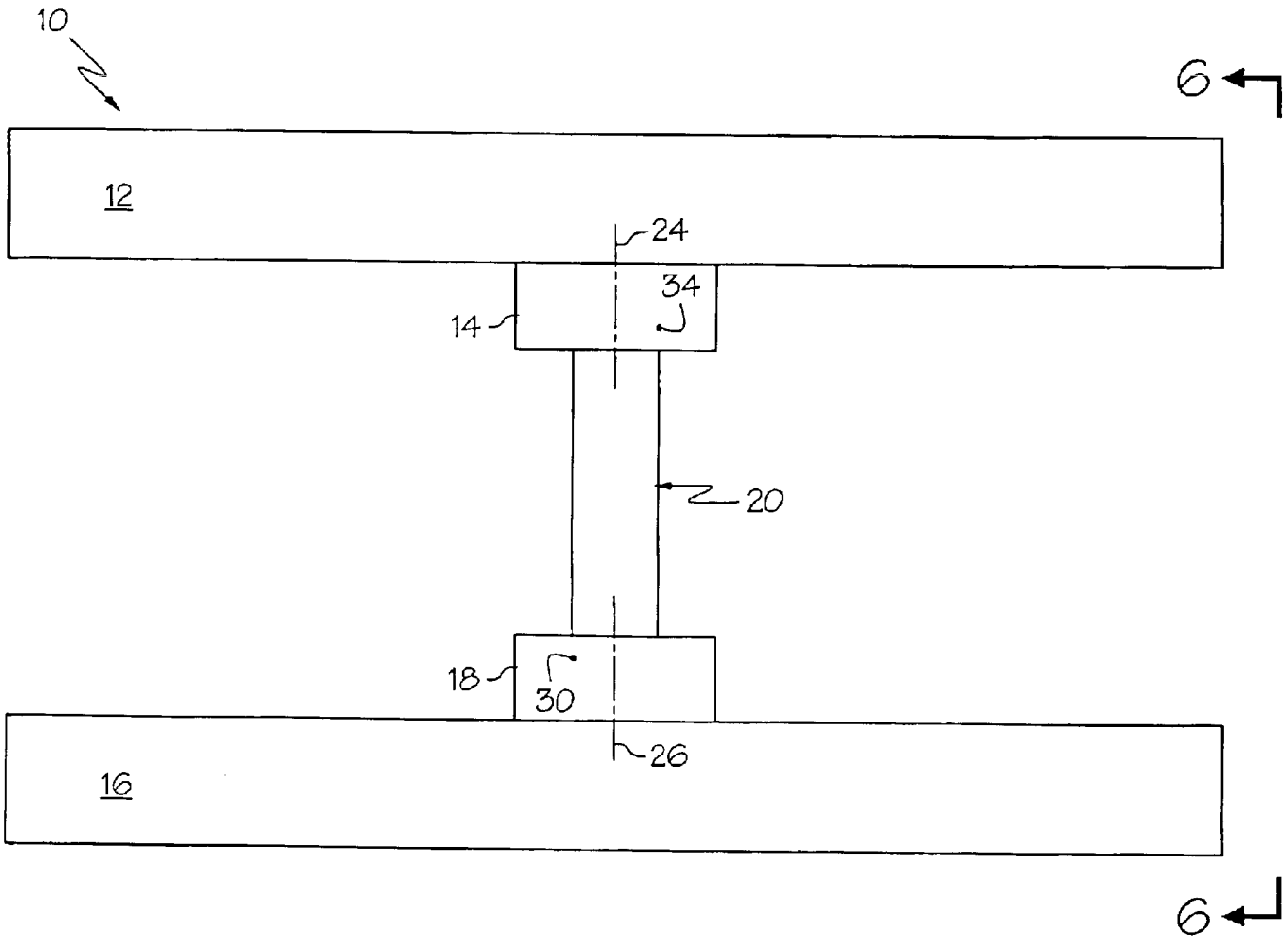
FIG. 5 is a simplified front elevational view of the infant activity center of FIG. 2 in the use configuration showing only one pylon and showing various rotational axes.
Figure 6:
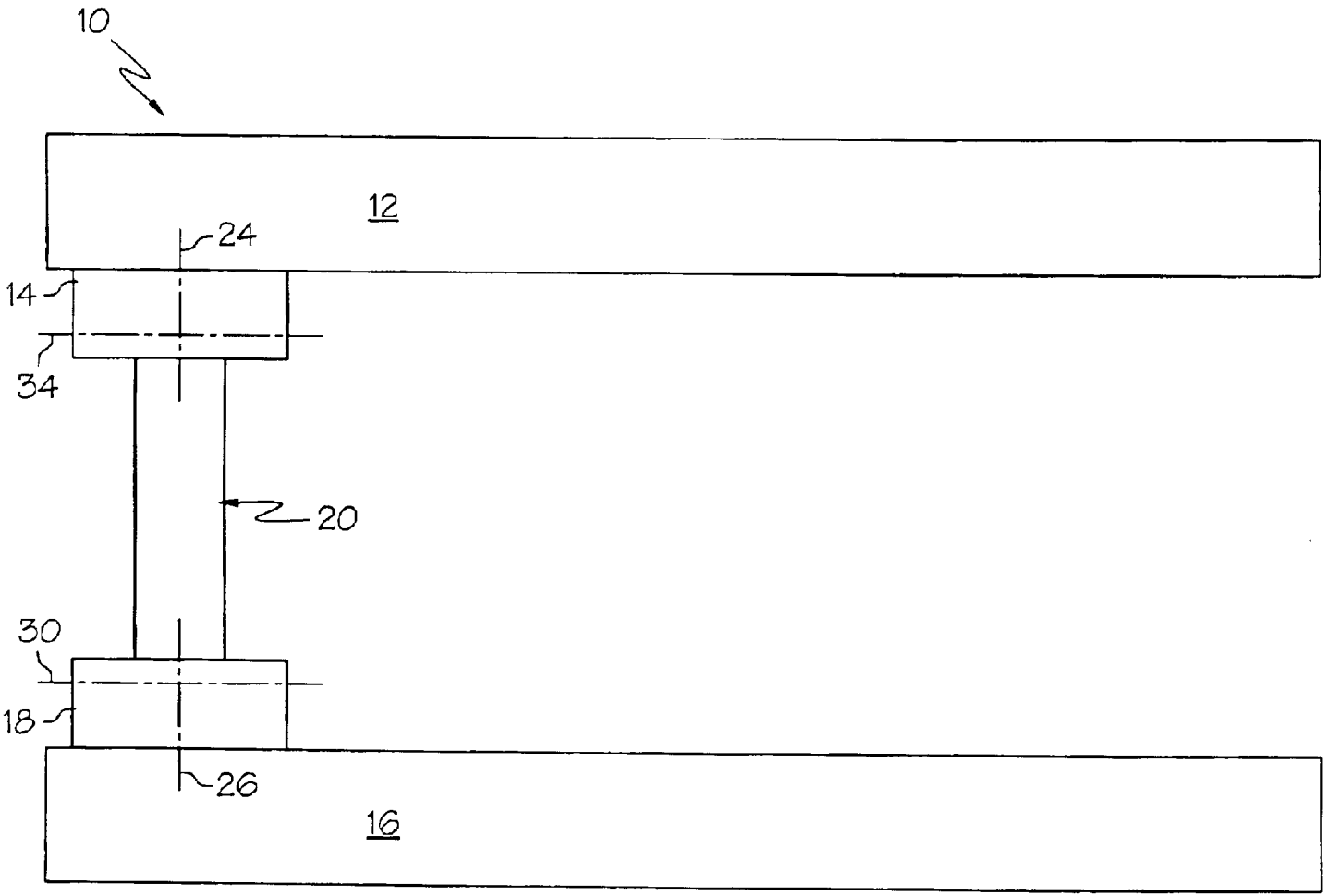
FIG. 6 is a simplified side elevational view of the infant activity center of FIG. 5 taken along lines 6—6 of FIG. 5.

In one example of the first expression of the embodiment shown in the figures, the infant activity center 10 also including means 38 (best seen in FIG. 9) for locking the tray 12 and the base 16 in the use position (seen in FIGS. 1–2) preventing the tray 12 and the base 16 from being relatively rotated and folded from the use position to the storage position and for unlocking the locked tray and base enabling the tray and the base to be relatively rotated and folded from the use position to the storage position (seen in FIG. 4). In one arrangement, the locking and unlocking means 38 includes at least one lower connecting member 18 having a recess 40 and includes the corresponding pylon 20 having a latch 42 engageable with and disengageable from the recess 40. In one variation, the latch 42 is a monolithic portion of the corresponding pylon 20. In one modification, each lower connecting member 18 has a recess 40, and each corresponding pylon 20 has a latch 42 engageable with and disengageable from the recess 40. In a different arrangement (not shown) of the locking and unlocking means, the latch of the pylon is engageable with and disengageable from a recess in at least one upper connecting member. In other arrangements, the locking and unlocking means includes lower and upper latches, the pylon has the notch and the lower or upper connecting member has the latch, or the latches are separate parts and not monolithic portions. In still other arrangements, the latch prevents rotation about a vertical axis of an upper connecting member with respect to the tray and/or a lower connecting member with respect to the base. In further arrangements, the latch and recess are replaced with other locking and unlocking devices such as rotational catches or other latching mechanisms.

In one choice of materials of the first expression of the embodiment shown in the figures, each pylon 20 consists essentially of plastic. In one variation, the tray 12, the base 16 each consist essentially of plastic. In the same or a different variation, the upper connecting members 14 and the lower connecting members 18 each consist essentially of plastic. Other materials are suitable but the use of plastic provides for a lighter weight infant activity center 10.

In one construction of the first expression of the embodiment shown in the figures, the plurality of pylons 20 consists of first, second and third pylons. In a different construction, the plurality of pylons consists of two pylons. In a further construction, the plurality of pylons consists of four pylons. Other constructions are left to the artisan.

In one configuration of the first expression of the embodiment shown in the figures, the substantially-horizontal lower and upper axes 30 and 34 point substantially toward the common central axis 44 of the base 16 and the tray 12 in the use position. In one variation a spring (not shown) rotationally biases the lower connecting member 18 to rotate to point axis 30 (with axis 34 following via the pylon connection to the rotatable upper connecting member) substantially toward the common central axis 44 of the base 16 and the tray 12 in the use position. Other configurations are left to those skilled in the art.

Figure 7:
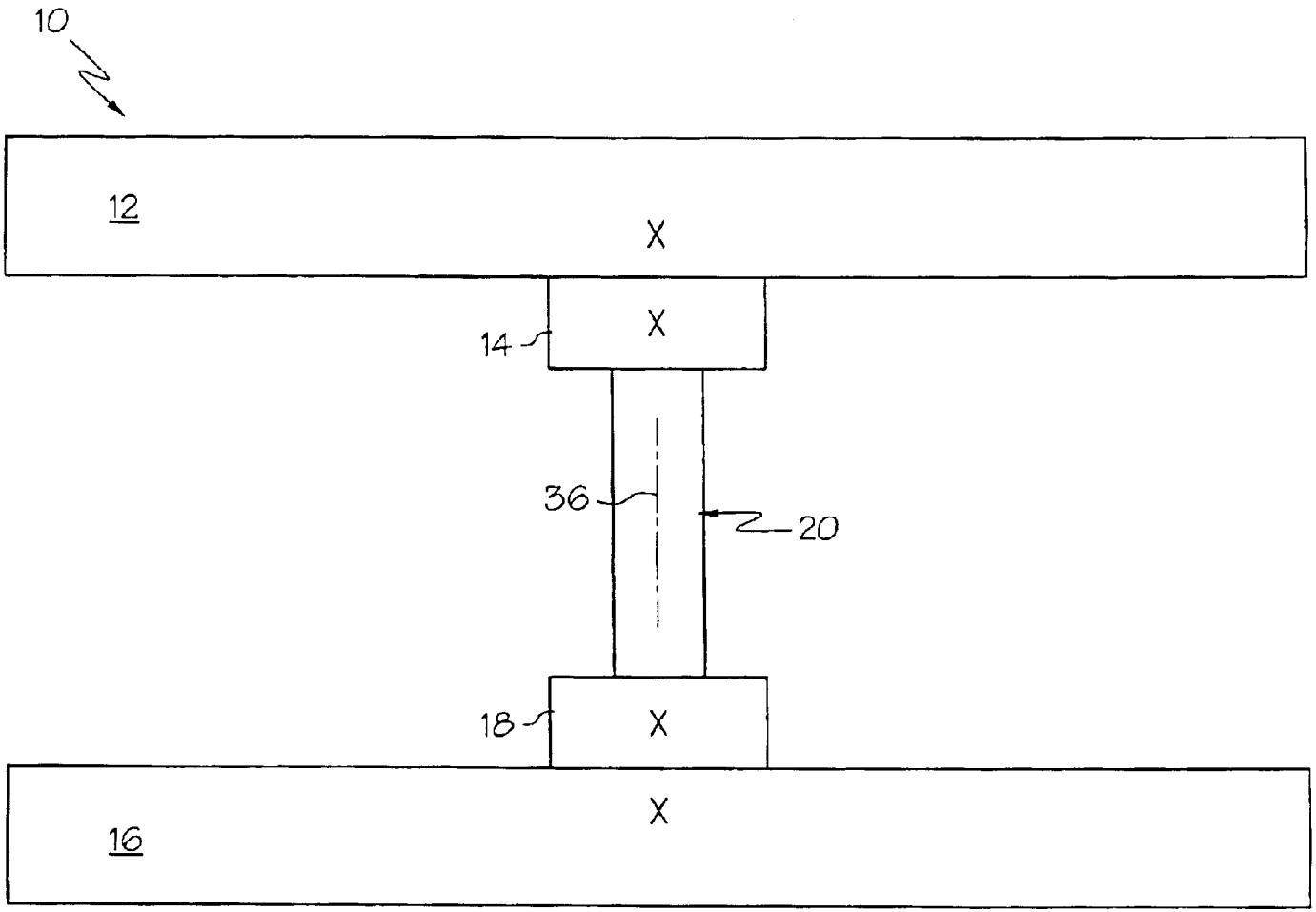
FIG. 7 is a view, as in FIG. 5, including an "X" marking locations on various parts before such parts undergo rotation and folding to enable the infant activity center to be changed from its use configuration to its storage configuration.
Figure 8:
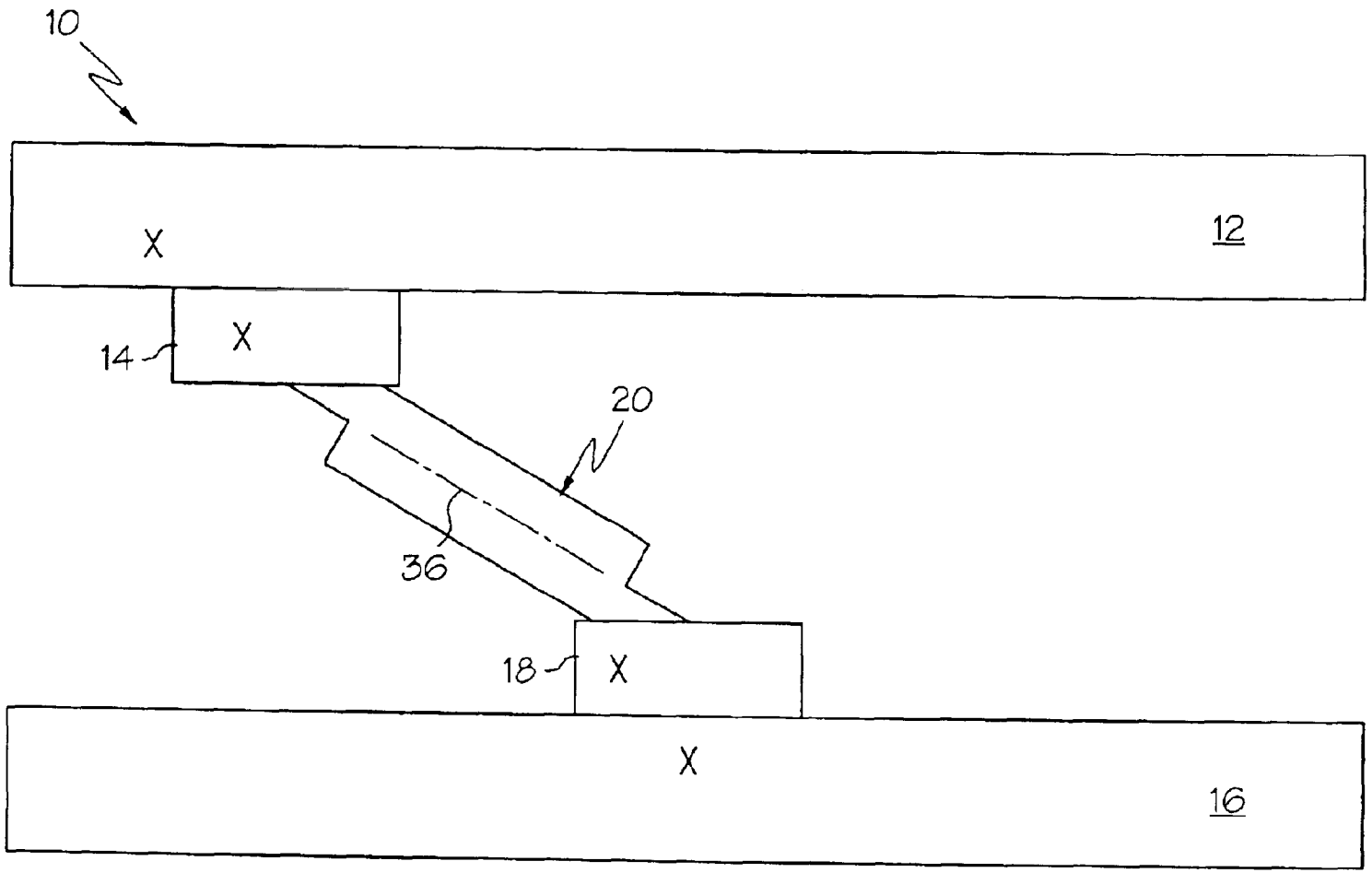
FIG. 8 is a view, as in FIG. 7, showing, through the positional changes of the "X" markings, the rotational movement of the parts as the infant activity center is about midway from being changed from its use configuration to its storage configuration.
Figure 9:
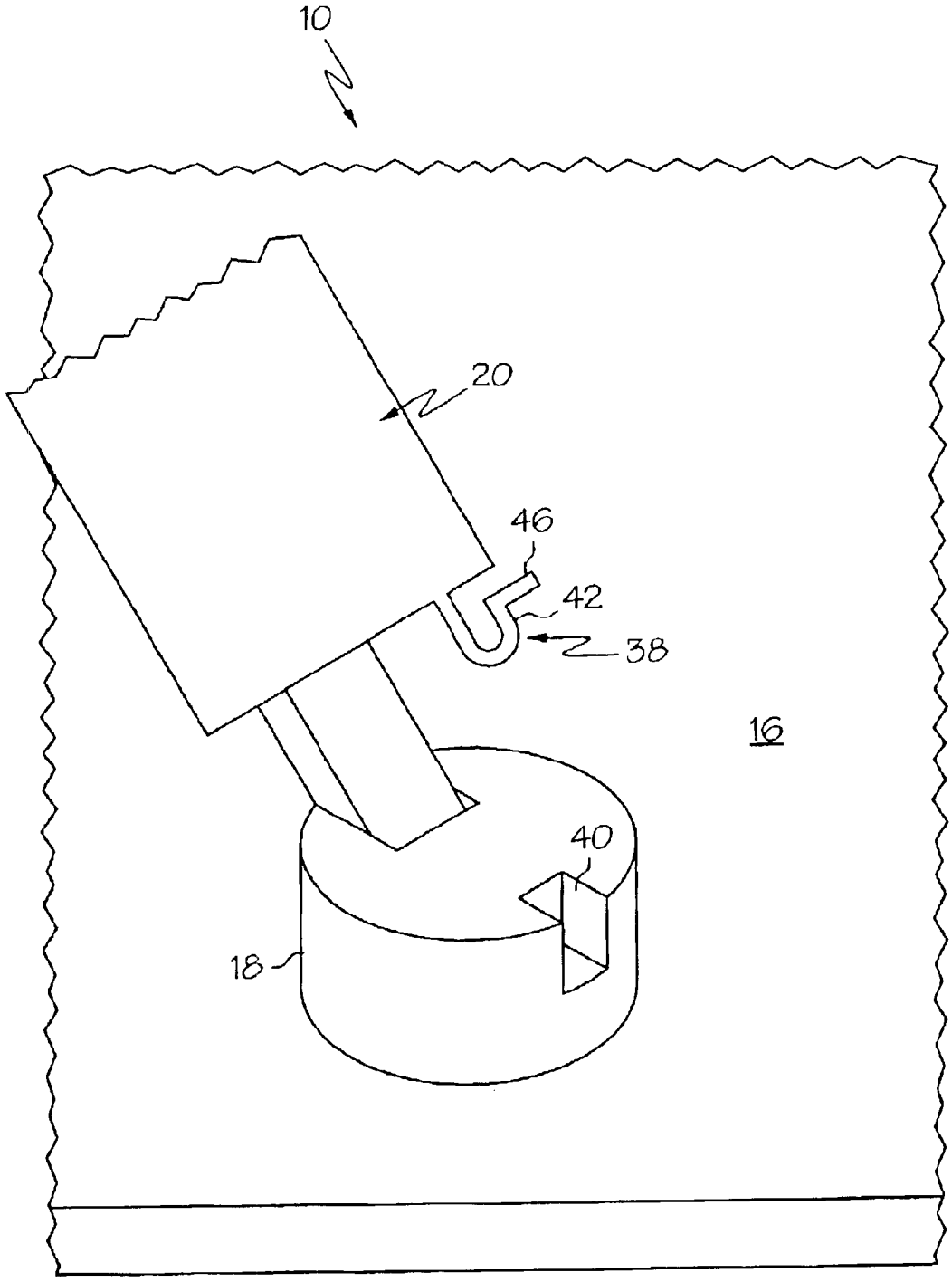
FIG. 9 is a perspective view of a portion of the infant activity center of FIG. 8 showing the latch used to lock and unlock the pylon from the lower connecting member.

In operation, in one method to change the infant activity center 10 from the use position (seen in FIGS. 1–2) to the storage position (seen in FIG. 4), first the user in turn pushes down on each latch tab 46 of each latch 42 of each pylon 20 to disengage latch 42 from recess 40 and then rotates the tray 12 slightly with respect to the base 16 about the central axis 44 to prevent automatic re-latching. Then, the user simultaneously relatively rotates the tray 12 with respect to the base 16 about the central axis 44 and pushes the tray 12 down toward the base 16 until the storage position is reached when further folding is not possible. FIGS. 7–8 have locations on certain parts marked with an "X" showing them in the use position (FIG. 7) and showing how such parts rotate (FIG. 8 shows a partially folded position) when rotating the tray and moving the tray toward the base for the storage position. An optional hook and notch arrangement (not shown) permits the tray 12 and the base 16 to remain in the storage position with the infant activity center 10 optionally standing on its side. To return the infant activity center 10 to its use position, with the base 16 placed on the floor or level ground and any optional hook and notch arrangement unhooked, the user lifts and counter-rotates the tray 12 with respect to the base 16 until the latches 42 automatically and lockingly engage the corresponding recesses 40.

A second expression of the embodiment of the invention shown in the figures is for an infant activity center 10 having an infant-activity-center tray 12, a plurality of upper connecting members 14, a base 16, a plurality of lower connecting members 18, and a plurality of substantially-rectilinear pylons 20. The tray 12 has an infant-receiving opening 22. The upper connecting members 14 are each attached to the tray 12 and are each rotatable with respect to the tray 12 only about a corresponding substantially-vertical upper axis 24. The lower connecting members 18 are each attached to the base 16 and are each rotatable with respect to the base 16 only about a corresponding substantially-vertical lower axis 26. The pylons 20 each have a lower portion 28 which is attached to a corresponding lower connecting member 18 and which is rotatable with respect to the corresponding lower connecting member 18 only about a corresponding substantially-horizontal lower axis 30 and each have an upper portion 32 which is attached to a corresponding upper connecting member 14 and which is rotatable with respect to the corresponding upper connecting member 14 only about a corresponding substantially-horizontal upper axis 34 enabling the tray 12 and the base 16 to be relatively rotated and folded from a use position (seen in FIGS. 1–2) to a storage position (seen in FIG. 4). The distance between the tray 12 and the base 16 is greater in the use position than in the storage position. Each of the pylons 20 is substantially vertical when the tray 12 and the base 16 are in the use position.

Several benefits and advantages are derived from one or more of the expressions of an embodiment of the invention. Having the pylons be substantially-rectilinear (i.e., substantially-straight) pylons which are substantially vertical when the tray and the base are in the use position provides for a stronger use position for like materials than pylons which are bent and/or which are tilted at an angle away from the vertical when the tray and the base are in the use position. A pylon which is vertical in the use position can be a two-piece inner-and-outer sleeve pylon providing for height adjustment without changing the vertical alignment of the pylon in the use position. Having each pylon be indirectly connected to the tray via an upper connecting member through separate horizontal and vertical axes of rotation and be indirectly connected to the base via a lower connecting member through separate horizontal and vertical axes of rotation provides more controlled motion than using any direct ball-and-socket connection for moving between the use and storage positions.

The foregoing description of several expressions of an embodiment of the invention has been presented for purposes of illustration. It is not intended to be exhaustive or to limit the invention to the precise form disclosed, and obviously many modifications and variations are possible in light of the above teaching.

What is claimed is:

1. An infant activity center comprising:

a) an infant-activity center tray having an infant-receiving opening;

b) a base c) a plurality of substantially-rectilinear pylons each having a lower portion which is directly or indirectly rotatably attached to the base and each having an upper portion which is directly or indirectly rotatably attached to the tray enabling the tray and the base to be relatively rotated and folded from a use position to a storage position, wherein the distance between the tray and the base is greater in the use position than in the storage position, and wherein each of the pylons is substantially vertical when the tray and the base are in use, and wherein at least one of the pylons further includes either a resiliently-biased latch attached thereto, or a recess therein, and wherein the base or the tray includes the other of the corresponding latch attached to a portion thereof or a recess therein, and wherein the latch is shaped to be received by the recess to lock the infant activity center in the use position.

2. The infant activity center of claim 1, wherein the tray is rotated either clockwise or counterclockwise with respect to the base to rotate and fold the tray from the use position to the storage position.

3. The infant activity center of claim 1, wherein each pylon consists essentially of plastic.

4. The infant activity center of claim 1, wherein the plurality of pylons consists of first, second end third pylons.

5. The infant activity center of claim 1, wherein each of the pylons is vertical when the tray and the base are in the use position.

6. The infant activity center of claim 1, wherein each of the pylons is substantially horizontal when the tray and the base are in the storage position.

7. An infant activity center comprising:

a) an infant-activity-center tray having an infant-receiving opening;

b) a plurality of upper connecting members each attached to the tray and each rotatable with respect to the tray only about a corresponding substantially-vertical upper axis;

c) a base;

d) a plurality of lower connecting members each attached to the base and each rotatable with respect to the base only about a corresponding substantially-vertical lower axis; and e) a plurality of substantially-rectilinear pylons each having a lower portion which is attached to a corresponding lower connecting member and which is rotatable with respect to the corresponding lower connecting member only about a corresponding substantially-horizontal lower axis and each having an upper portion which is attached to a corresponding upper connecting member and which is rotatable with respect to the corresponding upper connecting member only about a corresponding substantially-horizontal upper axis enabling the tray and the base to be relatively rotated and folded from a use position to a storage position, wherein the distance between the tray and the base is greater in the use position than in the storage position, and wherein each of the pylons is substantially vertical when the tray and the base are in the use position.

8. The infant activity center of claim 7, wherein the substantially-horizontal lower and upper axes of each pylon are always substantially parallel.

9. The infant activity center of claim 7, also including means for locking the tray and the base in the use position preventing the tray and the base from being relatively rotated and folded from the use position to the storage position and for unlocking the locked tray and base enabling the tray and the base to be relatively rotated and folded from the use position to the storage position.

10. The infant activity center of claim 9, wherein the locking and unlocking means includes at least one lower connecting member having a recess and includes the corresponding pylon having a latch engageable with and disengageable from the recess.

11. The infant activity center of claim 10, wherein the latch is a monolithic portion of the corresponding pylon.

12. The infant activity center of claim 11, wherein each lower connecting member has a recess, and wherein each corresponding pylon has a latch engageable with and disengageable from the recess.

13. The infant activity center of claim 12, wherein each pylon consists essentially of plastic.

14. The infant activity center of claim 7, wherein the plurality of pylons consists of first, second and third pylons.

15. The infant activity center of claim 7, wherein each of the pylons is substantially horizontal when the tray and the base are in the storage position.

16. The infant activity center of claim 7, wherein each pylon consists essentially of plastic.

* * * * *